US008420924B2

(12) United States Patent
Loftus

(10) Patent No.: US 8,420,924 B2
(45) **Date of Patent: *Apr. 16, 2013**

(54) ELECTROMAGNETIC FIELD PICKUP FOR MUSICAL INSTRUMENTS

(76) Inventor: Robert Francis Joseph Loftus, Sydney (AU)

( * ) Notice: Subject to any disclaimer, the term of this patent is extended or adjusted under 35 U.S.C. 154(b) by 0 days.

This patent is subject to a terminal disclaimer.

(21) Appl. No.: 13/361,705

(22) Filed: Jan. 30, 2012

(65) Prior Publication Data

US 2012/0125181 A1 May 24, 2012

Related U.S. Application Data

(63) Continuation of application No. 12/396,711, filed on Mar. 3, 2009.

(60) Provisional application No. 61/038,567, filed on Mar. 21, 2008.

(30) Foreign Application Priority Data

Mar. 4, 2008 (AU) ..... 2008901054

(51) Int. Cl.
*G10H 3/00* (2006.01)

(52) U.S. Cl.
USPC ..... 84/723; 84/725; 84/726; 84/735

(58) Field of Classification Search ..... None
See application file for complete search history.

(56) References Cited

U.S. PATENT DOCUMENTS

| | | | | |
|---|---|---|---|---|
| 3,637,913 | A * | 1/1972 | Evans | 84/738 |
| 5,206,449 | A | 4/1993 | McClish | |
| 5,693,904 | A | 12/1997 | Kihneman et al. | |
| 6,216,059 | B1 | 4/2001 | Ierymenko | |
| 6,610,917 | B2 * | 8/2003 | Ludwig | 84/726 |
| 6,696,632 | B2 | 2/2004 | Minakuchi et al. | |
| 6,770,807 | B1 | 8/2004 | Myers | |
| 6,846,980 | B2 * | 1/2005 | Okulov | 84/646 |
| 6,852,919 | B2 * | 2/2005 | Ludwig | 84/735 |
| 7,309,828 | B2 * | 12/2007 | Ludwig | 84/622 |
| 7,309,829 | B1 * | 12/2007 | Ludwig | 84/622 |
| 7,960,640 | B2 * | 6/2011 | Ludwig | 84/735 |
| 8,030,566 | B2 * | 10/2011 | Ludwig | 84/622 |
| 8,129,607 | B2 * | 3/2012 | Loftus | 84/723 |
| 2004/0099129 | A1 | 5/2004 | Ludwig | |
| 2006/0243123 | A1 | 11/2006 | Ierymenko | |
| 2009/0223353 | A1 | 9/2009 | Loftus | |
| 2010/0263521 | A1 | 10/2010 | Ierymenko et al. | |
| 2010/0275761 | A1 | 11/2010 | Ierymenko | |
| 2012/0125181 | A1 * | 5/2012 | Loftus | 84/726 |

FOREIGN PATENT DOCUMENTS

| | | |
|---|---|---|
| WO | WO 01/16554 A2 | 3/2001 |

* cited by examiner

*Primary Examiner* — Marlon Fletcher

(74) *Attorney, Agent, or Firm* — Biotech Beach Law Group PC

(57) ABSTRACT

An electromagnetic field pickup (10) for a musical instrument including an electromagnetic signal generator (12), an electromagnetic field transducer (18), a mixer (28), the electromagnetic signal generator (12), the electromagnetic field transducer (18) and the mixer (28) are respectively connected in series, the electromagnetic signal generator (12) is also connected directly to the mixer (28), so constructed and arranged that when power is supplied to the electromagnetic field pickup (10) an audio electrical signal of substantially same pitch, intonation and sustain as a vibrating element (22) of the instrument is generated.

3 Claims, 3 Drawing Sheets

ELECTROMAGNETIC FIELD PICKUP FOR MUSICAL INSTRUMENTS

CROSS-REFERENCE TO RELATED APPLICATIONS

The present invention is a continuation of U.S. patent application Ser. No. 12/396,711 filed Mar. 3, 2009, which claims benefit of priority to U.S. patent application Ser. No. 61/038,567, filed on Mar. 21, 2008 now expired and Australia patent application serial number 2008901054, filed on Mar. 4, 2008; the contents of each are herein incorporated by reference.

BACKGROUND OF INVENTION

1. Technical Field

The present invention has application to the field of music and to the sub fields of electrical musical tone generation using transducers and electromagnetic fields and with particular application to stringed and percussion instruments.

2. Background Art

Since Thomas Edison first used a vibrating thorn to cut a sound track in a revolving wax cylinder producing a very rough and poor quality sound by contemporary standards, many scientists, inventors and experimenters have striven for perfect reproduction and recording of sound and music, using devices referred to as "pickups" to detect and attempt to reproduce sound produced by musical instruments.

The imperfections and limitations of current electrical pickups have generated a vast multitude of variations and combinations of pickup types with a sole goal of achieving perfect electrical reproduction of sound.

The reproduced sound from many musical instruments relies upon a pickup conversion process to convert mechanical musical vibrations into an electrical signal that can be amplified and recorded.

Types of conventional pickups include:

a) a magnetic pickup which includes an inductive coil surrounding a permanent magnet;
b) a piezoelectric pickup which includes vibration sensitive crystalline material;
c) an acoustic pickup which includes a microphone with a vibration sensitive diaphragm;
d) an optical pickup which includes a light source and a phototransistor detector;
e) and combinations of above types of pickups.

General problems with background art:

a) conventional pickup systems rely on intermediary mediums to transfer a primary mechanical musical vibration to a pickup's electrical signal generating components;
b) the conventional pickup can load a primary mechanical musical vibrating element and distort true pitch and intonation of the element and reduce sustain and limit amplitude and frequency response of a resulting electrical signal.

Specific problems with background art including:

a) magnetic pickup needs steel strings to vibrate in a magnetic field with a large inductive coil to pick up audio frequency vibrations consequently loading a vibrating string and reducing a resulting frequency response;
b) a piezoelectric pickup needs a vibrating component including at least one of a bridge and a soundboard, often leading to a poor low frequency response;
c) an acoustic microphone relies upon variations in air pressure to transfer a musical vibration and is subject to an external noise and frequency response limitation;

d) an optical pickup requires a light source and detector to be above and below each of an instrument's strings without affecting operation of an instrument, the optical pickup is receptive to displacement of a string's shadow in one dimension only, and accordingly, information pertaining to sound received by an optical pickup is limited as a string vibrates in three dimensions, as a result sound reproduction is limited in quality and physical requirements limit the optical pickup's application to a bridge area of the instrument.

SUMMARY OF INVENTION

Technical Problem

To substantially solve the general problems and the specific problems as recited above.

Technical Solution

Transmitting a radiated electromagnetic field (a first electromagnetic field) to a vibrating element of a musical instrument, receiving a re-radiated and modulated electromagnetic field (a second electromagnetic field) from the vibrating element, subtracting a first electromagnetic signal used to produce the first electromagnetic field from a second electromagnetic signal derived from the second electromagnetic field to produce a difference signal (audio signal), where the difference signal will precisely replicate vibration of the vibrating element with respect to pitch, sustain and intonation of vibration and where the reradiated and modulated electromagnetic signal is subject to "Doppler" frequency shift modulation caused by the vibrating element.

The solution is a direct conversion process without any intermediary medium, which will provide an accurate and true electrical reproduction of sound emitted by the vibrating element of the instrument.

Advantageous Effects

Advantageous effects include:

a) accurate reproduction of a full frequency range of sound emitted by of an instrument;
b) preservation of relative amplitude and duration of each frequency;
c) use of conventional electrical components in combination resulting in reduced development and manufacturing costs;
d) enhancement of quality of a recording and reproduction of music from an instrument;
e) simplification of pickup construction resulting in increased flexibility and improvement in the instrument's aesthetic appearance;
f) reduced size allowing greater application flexibility and easier retro fitting to the instrument;
g) low power consumption allowing internal battery operation;
h) can be used with a non-metallic vibrating element if high electromagnetic frequencies are used;
i) electromagnetic signal frequency alignment is completely automatic;
j) increasing scope of creativity for an artist using the instrument;
k) faithfully reproduces true pitch, intonation and superior sustain of the instrument;

l) close proximity of the pickup to a vibrating element of the instrument does not affect the vibrating element including when the vibrating element is a string;

j) the pickup exhibits greater sensitivity than a conventional pickup and so can operate at a greater distance from the vibrating element.

In a first aspect of invention, an electromagnetic field pickup for a musical instrument comprising:

a) an electromagnetic signal generator;

b) an electromagnetic field transducer;

c) a mixer;

the electromagnetic signal generator, the electromagnetic field transducer and the mixer are respectively connected in series;

the electromagnetic signal generator is also connected directly to the mixer;

so constructed and arranged that when power is supplied to the electromagnetic field pickup an audio electrical signal of substantially same pitch, intonation and sustain as a sound vibration from a vibrating element of the musical instrument is generated.

Another feature of the first aspect of invention includes, a filter connected to the mixer.

Another feature of the first aspect of invention includes, an audio amplifier connected to the filter.

Another feature of the first aspect of invention includes where the mixer is a mixer diode biased to operate in a linear region of the mixer diode's range of operation.

Another feature of the first aspect of invention includes where the electromagnetic field transducer includes an array of dielectric chip antennas.

Another feature of the first aspect of invention includes where the dielectric chip antennas are oriented with respect to the vibrating element so that a radiated field produced by the dielectric chip antennas has a same polarization as the vibrating element.

Another feature of the first aspect of invention can include where the electromagnetic field transducer is a waveguide antenna having at least one slot.

Another feature of the first aspect of invention can include where alignment of the waveguide antenna with respect to a string of the vibrating element is such as to place the slot substantially at right angle to the string and to place the string substantially over a centre of the slot so that a radiated field emitted from the slot has a same polarization as the string.

In a second aspect of invention, a method for generating a musical frequency audio electrical signal comprising a step of:

subtracting a first electromagnetic signal from a second electromagnetic signal to produce a difference signal;

the first electromagnetic signal and the second electromagnetic signal are of substantially same frequency;

the first electromagnetic signal is modulated by vibration of a vibrating element of a musical instrument to produce the second electromagnetic signal;

the difference signal is the musical frequency audio electrical signal of substantially same pitch, intonation and sustain as a sound vibration of the vibrating element of the musical instrument.

Another feature of the second aspect of invention includes steps of:

a) transmitting a first electromagnetic field towards the vibrating element;

b) receiving a second electromagnetic field from the vibrating element;

the first electromagnetic field is derived from the first electromagnetic signal;

the second electromagnetic field is derived by re-radiation and modulation of the first electromagnetic field;

the second electromagnetic signal is derived from the second electromagnetic field.

Another feature of the second aspect of invention includes a step of filtering out additional signals generated with the difference signal.

Another feature of the second aspect of invention includes, where transmitting the first electromagnetic field comprises transmitting a radio frequency field.

Another feature of the second aspect of invention can include, where transmitting the first electromagnetic field comprises transmitting a microwave frequency field.

DETAILED DESCRIPTION

Best Mode

Definitions and Terms

"Detection", also called demodulation, is a process of recreating original modulating frequencies (intelligence) from frequencies which are present in a composite signal", extracted and adapted from Basic Electronics, Prepared by Bureau of Naval Personnel, Dover, first published 1973, at p 232.

Consistent with the definition of "detection" as recited above, a term "mixer" can further comprise filtration.

Modulation—"Radio—in radio transmission, the process whereby the frequency, amplitude, or some other property of a carrier wave (signal-carrying wave) is made to increase or decrease instantaneously in response to variations in the characteristics of the signal being transmitted"—Chambers Concise Dictionary & Thesaurus, Chambers Harrap Publishers, Edinburgh, 2001.

A transducer is "A device that converts one form of energy into another. Electronic transducers either convert electric energy to another form of energy or convert non electric to electric energy", Microsoft Computer Dictionary, Fifth Edition, Microsoft Press 2002. Accordingly, term "transducer" can refer to a single integrated device for purpose of reception and transmission of electromagnetic energy. Similarly, a transducer can include a device having a separate component for transmission of electromagnetic energy and a separate component for reception of the electromagnetic energy.

Term Doppler effect (shift) is defined to mean "the change in wavelength observed when the distance between a source of waves and the observer is changing, eg the sound change perceived as an aircraft or vehicle passes by (19c: named after the Austrian physicist Christian Doppler)" Chambers Compact Dictionary, Chambers Harrap Publishers, Edinburgh, 2005. Accordingly, term "Doppler effect" ("Doppler shift") includes a reference to an effect that is common to all electromagnetic wave phenomena and is produced when an object moves relative to a source of the electromagnetic wave, resulting in a Doppler shifted electromagnetic wave that will exhibit a change in frequency and wavelength that is related to frequency of movement of the object.

Term "electromagnetic field", as used in specification can include any electromagnetic wave radiation that can reliably produce a Doppler frequency shifted electromagnetic signal for use with a musical instrument. The term "electromagnetic field" includes, any ultrasonic, radio frequency, microwave, infrared, visible spectrum, and ultra violet electromagnetic wave radiation.

Term "electromagnetic signal" can include a reference to a process of generation of the signal.

Accordingly, when a musical instrument's vibrating element oscillates in an electromagnetic field, the vibrating element causes Doppler shifting in frequency of the electromagnetic field that is related to frequency of vibration of the vibrating element.

Power supplies below are not illustrated and the power supplies, with associated filtration of input power is assumed inherent.

Figure 1:
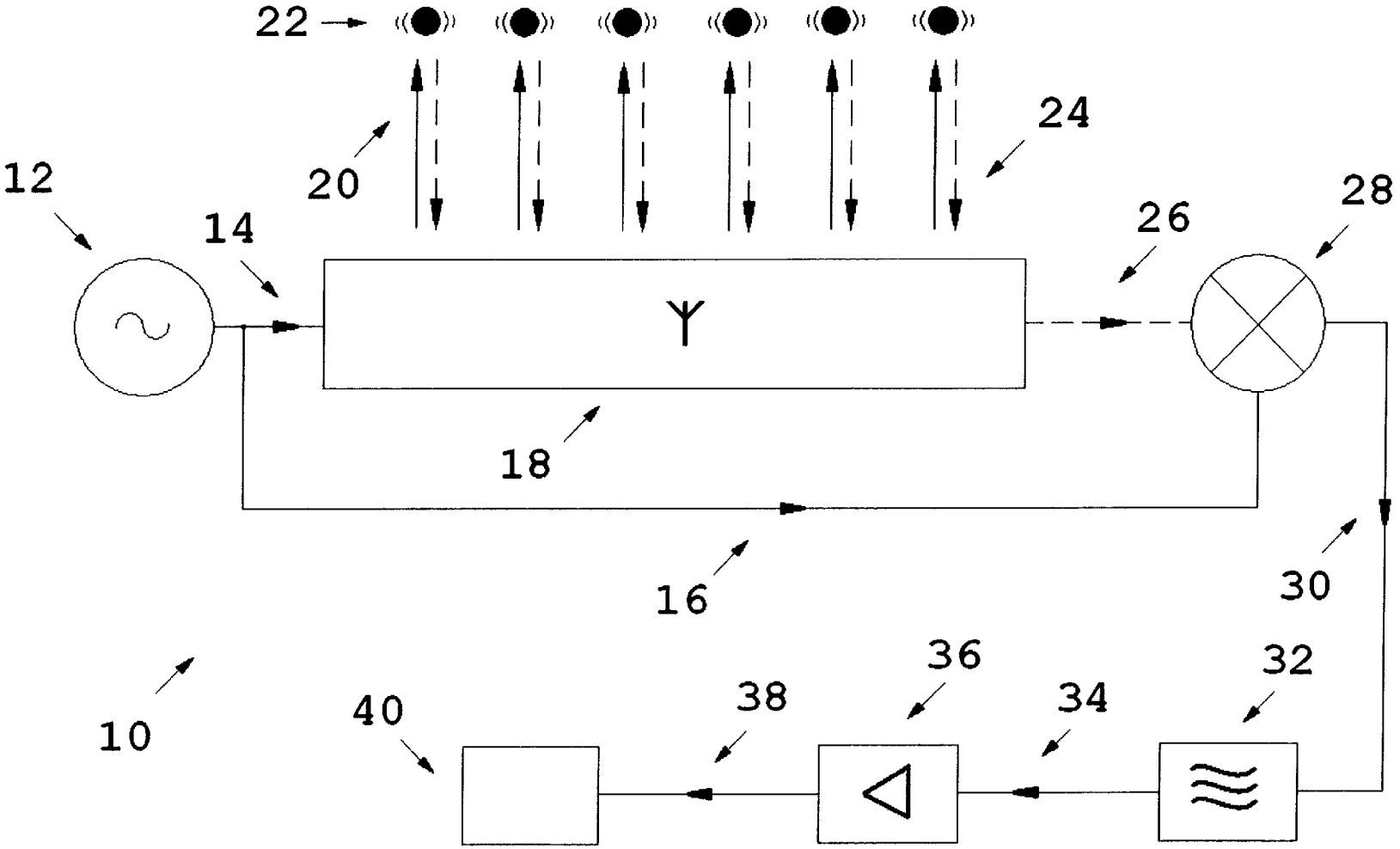
FIG. 1 discloses a best mode of invention for use with an electric guitar.

FIG. 1 discloses a best mode of invention, in general form, for use with a steel string electric guitar.

An electromagnetic signal generator 12 produces a first electromagnetic signal 14 at 2.4 GHz, the first electromagnetic signal 14 is sent to electromagnetic field transducer 18 and a second electromagnetic signal 16 is sent to mixer 28.

Figure 2:
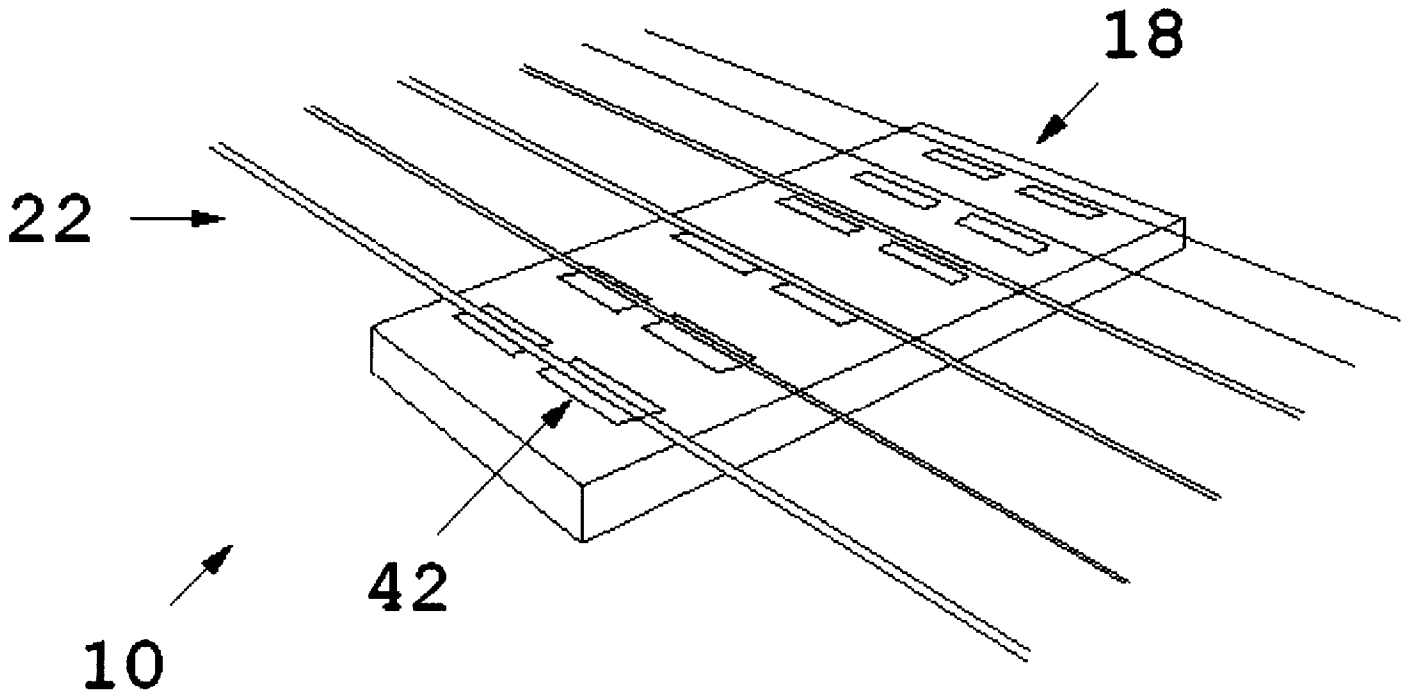
FIG. 2 discloses an isotropic view of a best mode of invention.

The electromagnetic field transducer 18 includes an array of 2.4 GHz dielectric chip antennas 42 as best seen in FIG. 2. The electromagnetic field transducer 18 radiates a first electromagnetic field 20 towards an instrument's vibrating element 22 illustrated as strings in FIG. 1.

The strings are vibrating at an audio frequency so as to cause a Doppler frequency shift in the first electromagnetic field 20. After Doppler shifting the first electromagnetic field 20 is re-radiated and modulated and represented as the second electromagnetic field 24. The second electromagnetic field 24 is reflected back towards the electromagnetic field transducer 18.

The electromagnetic field transducer 18 receives the second electromagnetic field 24 and a third electromagnetic signal 26 is then sent to the mixer 28. The mixer 28 is a linear mixer. The third electromagnetic signal 26 contains effects of Doppler shifting contained in the second electromagnetic field 24.

The mixer 28 mixes the third electromagnetic signal 26 and the second electromagnetic signal 16 to produce a fourth electromagnetic signal 30. The fourth electromagnetic signal 30 also includes effects of Doppler shifting contained in the second electromagnetic field 24.

Components of the fourth electromagnetic signal 30 include the second electromagnetic signal 16, the third electromagnetic signal 26, a summation signal and a difference signal (the difference signal is later filtered out and represented as a fifth electromagnetic signal 34). The summation signal is an addition of the second electromagnetic signal 16 and the third electromagnetic signal 26. The difference signal is a subtraction between the second electromagnetic signal 16 and the third electromagnetic signal 26. The fourth electromagnetic signal 30 is sent to a filter 32.

The filter 32 removes all electromagnetic signals except for the difference signal represented as the fifth electromagnetic signal 34. The fifth electromagnetic signal 34 is in an audio frequency signal and can be referred to as an audio signal, which has same frequency of vibration as the strings represented as the vibrating element 22. The fifth electromagnetic signal 34 is then sent to audio amplifier 36.

The audio amplifier 36 amplifies and processes the fifth electromagnetic signal 34 to produce an additional audio frequency signal represented as a sixth electromagnetic signal 38. The sixth electromagnetic signal 38 is then sent to output connection 40. Output connection 40 can interface and connect with an external device. The external device can include a main amplification unit. In another mode, the external device can include recording equipment.

The electromagnetic field pickup is an active device and can be powered by an external DC supply. The pickup can also be powered by an internal battery supply.

FIG. 2 is an isotropic view of a best mode of invention. An electromagnetic field pickup 10 includes an electromagnetic field transducer 18; the electromagnetic field transducer 18 includes an array of radiating 2.4 GHz dielectric chip antennas 42. Alignment of the dielectric chip antennas 42 is such that the first electromagnetic field 20 seen in FIG. 1 is in a same polarization as the vibrating element 22.

Mode for Invention

Figure 3:
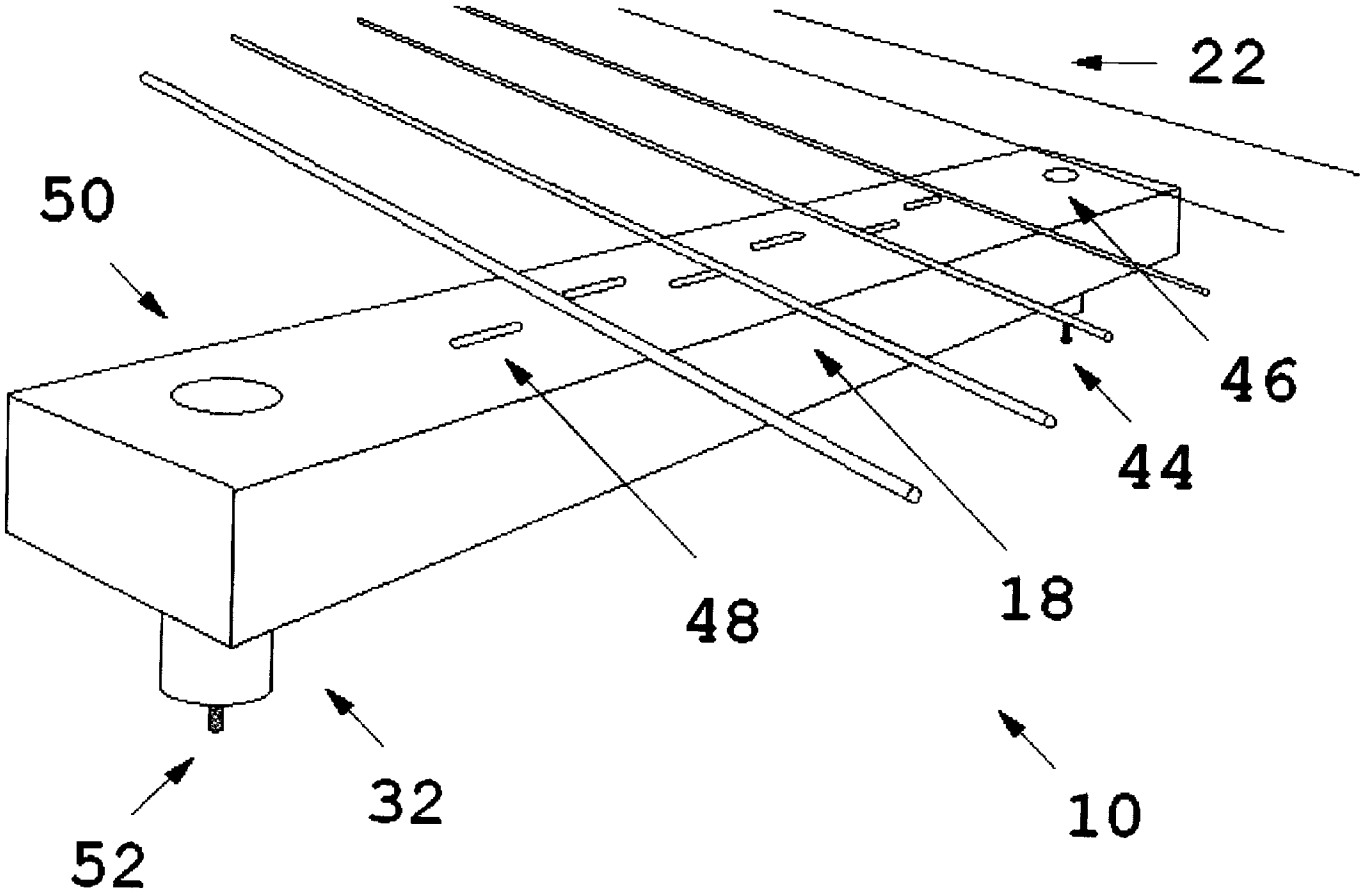
FIG. 3 An isotropic view of a mode of invention for use with a steel stringed electric guitar and for use with a nylon stringed acoustic guitar.

FIG. 3 is an isotropic view of a 24 GHz mode of invention for nylon stringed acoustic guitars and steel stringed electric guitars. General, mode of operation of embodiment illustrated in FIG. 3 is as illustrated and described in relation to FIG. 1 and FIG. 2.

The electromagnetic field transducer 18 (depicted generally in FIG. 1) takes a specific form of a six-slot waveguide antenna in FIG. 3. The electromagnetic signal generator 12 (seen in FIG. 1) is mounted in a first chamber 46 at a distal portion of the six-slot waveguide antenna and powered through connection 44. The electromagnetic signal generator 12 located in the first chamber 46 in FIG. 3 is a Gunn device electromagnetic signal generator.

The mixer 28 seen in FIG. 1 is located in a second chamber 50 at a proximal portion of the six-slot waveguide antenna. The first chamber 46 is continuous with the second chamber 50. The mixer 28 in FIG. 3 is a mixer diode. The mixer diode is biased to operate in a linear part of the mixer diode's range of operation by a DC bias voltage fed to, connection 52.

The electromagnetic field transducer 18, seen in FIG. 3 as the 6-slot waveguide antenna, radiates a first electromagnetic field 20 from each of slots 48 in the 6-slot waveguide antenna towards an instrument's vibrating element 22, shown in FIG. 3 as a set of strings. The 6-slot waveguide antenna also receives a second electromagnetic field 24 from the strings (as best seen in FIG. 1).

Alignment of each of the slots 48 in the 6-slot waveguide antenna is such that the strings are substantially at right angles to each of the slots and each of the strings rests over a centre of one of the slots. Generation of the difference signal 34 referred to in FIG. 1 occurs in FIG. 3 using same processes described in relation to FIG. 1.

The difference signal 34 is an audio signal. The difference signal 34 has a frequency that is substantially same frequency of vibration of the strings and is outputted via a dc blocking capacitor from the connection 52.

At 24 GHz the electromagnetic field pickup 10 is very sensitive to vibrations of both metallic and non-metallic strings and vibrating surfaces. There is also sensitivity to hand movements, an effect that could be used creatively by an artist to add to music played on the instrument.

Industrial Applicability

In use, modes of invention can be applied to stringed instruments including guitars, violins and harps. Modes of invention can also be applied to percussion instruments including drums. Further, modes of invention can be applied to wind instruments. Modes of invention can be used with instruments having strings constructed from materials including nylon and steel.

Modes of invention applied to non-metallic vibrating musical surfaces are best seen to use frequencies above 10 GHz (Gigahertz). Modes of invention for metallic surfaces used with frequencies above 10 GHz can exhibit hand distortions caused by hand movement. The distortions can be removed by lowering the frequencies. The distortions can also be used to provide additional artistic effect.

Modes of invention applied to metallic only vibrating musical surfaces are seen to operate best using radio frequency signals between 1 and 10 GHz.

Additional modes of invention can be contemplated in use. The mixer 28 can be implemented in various embodiments including a diode, a transistor and an integrated circuit provided that the mixer 28 is capable of satisfying essential feature of invention of mixing a first electromagnetic signal (unmodulated) and a second electromagnetic signal (modulated) so as to generate a difference signal (audio signal) where the first electromagnetic signal and the second electromagnetic signal are of substantially same frequency.

In practical use of electromagnetic signals, mixing of the first electromagnetic signal (unmodulated) and the second electromagnetic signal (modulated) of substantially same frequency, respectively associated with a first electromagnetic field and a second electromagnetic field, has been discouraged because of potential phase differences leading to presence of a low frequency beat. In case of musical instruments, short distances between a pickup and a vibrating element mean that the low frequency beat is unlikely to represent a problem in generation of the resultant difference signal (audio signal). Substantial absence of the low frequency beat, over short distances, means that mixing of the first electromagnetic signal (unmodulated) and the second electromagnetic signal (modulated) of substantially same frequency is of practical utility when applied to musical instruments.

Further, in use, audio amplification is not critical to operation of invention in all embodiments. In various uses it is envisaged that amplification level of the difference signal (audio signal) can be sufficient for direct entry into an external device.

Further, modes of invention, in use, are seen in FIG. 2 and FIG. 3.

In use, FIG. 2 shows the electromagnetic field pickup 10 using an array of radiating 2.4 GHz dielectric chip antennas 42. FIG. 2 shows position of the 2.4 GHz dielectric chip antennas 42 in relation to the vibrating element 22 illustrated as strings in FIG. 2.

Further, in use, FIG. 3 shows the electromagnetic field pickup 10 using a 6-slot waveguide antenna as the electromagnetic field transducer 18. FIG. 3 also shows position of the 6-slot waveguide antenna in relation to the vibrating element 22 illustrated as strings in FIG. 3.

I claim:

1. A pickup for a musical instrument comprising:

a signal generator;

a transducer;

a mixer;

so constructed and arranged that when power is supplied to the pickup a first signal and a second signal are respectively sent from the signal generator to the transducer and the mixer;

a first field derived from the first signal is transmitted from the transducer towards a vibrating element of the musical instrument;

a second field derived by re-radiation and Doppler shifted modulation of the first field is received from the vibrating element by the transducer;

a third signal derived from the second field is sent from the transducer to the mixer;

the third signal and the second signal are mixed by the mixer-to produce a fourth signal; and the fourth signal includes a difference signal being a musical frequency audio electrical signal of substantially same pitch, intonation and sustain as a sound vibration from the vibrating element of the musical instrument.

2. A pickup for a musical instrument comprising:

signal generator means, being means for generating a signal;

transducer means, being means for converting between a signal and a field;

mixer means, being means for mixing signals;

so constructed and arranged that when power is supplied to the pickup a first signal and a second signal are respectively sent from the signal generator means to the transducer means and the mixer means;

a first field derived from the first signal is transmitted from the transducer means towards a vibrating element of the musical instrument;

a second field derived by re-radiation and Doppler shifted modulation of the first field is received from the vibrating element by the transducer means;

a third signal derived from the second field is sent from the transducer means to the mixer means;

the third signal and the second signal are mixed by the mixer means to produce a fourth signal;

the fourth signal includes a difference signal being a musical frequency audio electrical signal of substantially the same pitch, intonation and sustain as a sound vibration from the vibrating element of the musical instrument.

3. A pickup for a musical instrument comprising:

an ultrasonic signal generator;

a transducer;

a mixer;

so constructed and arranged that when power is supplied to the pickup a first signal and a second signal are respectively sent from the ultrasonic signal generator to the transducer and the mixer;

a first field derived from the first signal is transmitted from the transducer towards a vibrating element of the musical instrument;

a second field derived by re-radiation and Doppler shifted modulation of the first field is received from the vibrating element by the transducer;

a third signal derived from the second field is sent from the transducer to the mixer;

the third signal and the second signal are mixed by the mixer to produce a fourth signal; and the fourth signal includes a difference signal being a musical frequency audio electrical signal of substantially same pitch, intonation and sustain as a sound vibration from the vibrating element of the musical instrument.

* * * * *